United States Patent [19]

Ichikawa et al.

[11] 4,230,074

[45] Oct. 28, 1980

[54] MOTORCYCLE TYPE INTERNAL COMBUSTION ENGINE HAVING OPTIMALLY DISPOSED VALVE ACTUATING MECHANISMS

[75] Inventors: Satoru Ichikawa, Hamamatsu; Shunji Minami, Iwata, both of Japan

[73] Assignee: Yamaha Hatsudoki Kabushiki Kaisha, Iwata, Japan

[21] Appl. No.: 944,651

[22] Filed: Sep. 21, 1978

[30] Foreign Application Priority Data

Sep. 29, 1977 [JP] Japan ..... 52-117206

[51] Int. Cl.[3] ..... F02B 75/22; F02B 75/24

[52] U.S. Cl. ..... 123/55 R; 123/55 VF; 123/55 V; 123/56 AA; 123/90.27; 123/90.31

[58] Field of Search ..... 123/90.31, 90.27, 55 V, 123/55 VE, 55 VF, 55 VS, 56 AA, 55 R, 56 R

[56] References Cited

U.S. PATENT DOCUMENTS

| | | | |
|---|---|---|---|
| 2,749,893 | 6/1956 | Porsche | 123/90.31 |
| 2,789,549 | 4/1957 | Brill | 123/90.31 |
| 3,738,338 | 6/1973 | Wickman | 123/90.27 |

FOREIGN PATENT DOCUMENTS

| | | | |
|---|---|---|---|
| 21924 | 12/1956 | Fed. Rep. of Germany | 123/55 VS |
| 464016 | 4/1937 | United Kingdom | 123/90.31 |

*Primary Examiner*—Wendell E. Burns
*Attorney, Agent, or Firm*—Donald D. Mon

[57] ABSTRACT

A multiple bank internal engine for a motorcycle has staggered cylinders which form a recess at one side of one bank of cylinders, and another recess at the opposite ends of another bank of cylinders. Valve actuating mechanisms are accommodated in these recesses so as to minimize the axial length of the engine, and thereby minimizing the width of the envelope occupied by the engine when mounted on a motorcycle.

8 Claims, 3 Drawing Figures

MOTORCYCLE TYPE INTERNAL COMBUSTION ENGINE HAVING OPTIMALLY DISPOSED VALVE ACTUATING MECHANISMS

The invention relates to improvements in a V-type or horizontally opposed 4-cycle engine to be incorporated in a motorcycle.

Such engines are conventionally mounted to a motorcycle in such a way that the crank shaft extends transversely of the motorcycle body. The front and rear cylinders are arranged in a V-shape fashion, generally in the vertical forward plane of the motorcycle. Thus, the conventional motor has had a relatively large longitudinal dimension, meaning a large width on the motorcycle. It also has recesses in one side of the front cylinders and in the other side of the rear cylinders.

In view of the foregoing considerations, the present invention has for its object to reduce the envelope width of such an engine by usefully utilizing the said recesses. A feature of the present invention resides in that interlocking devices for coupling intake and exhaust valve cam drive mechanisms with the crank shaft are placed in the recesses.

The above and other features of this invention will be fully understood from the following detailed description and the accompanying drawings, in which.

Figure 1:
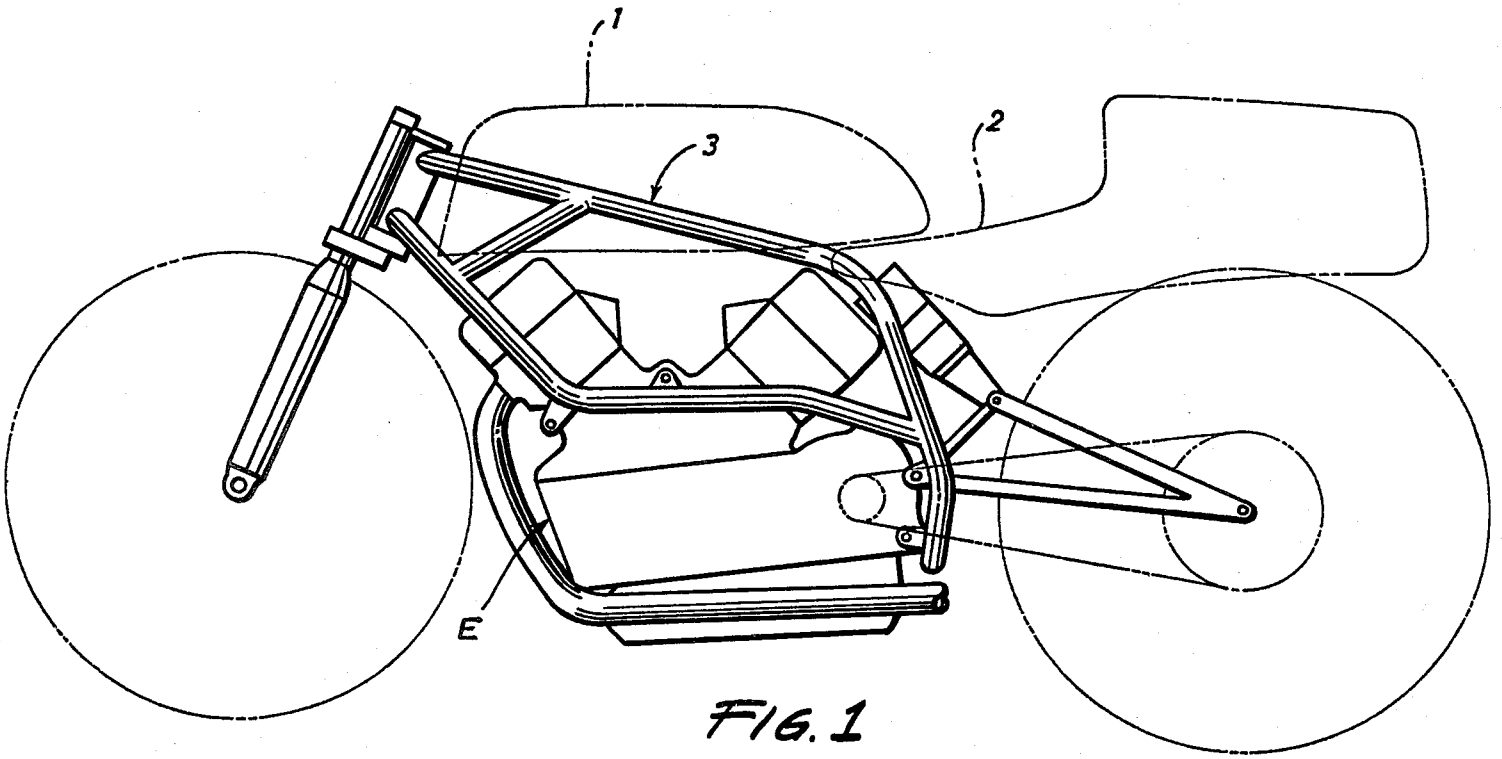
FIG. 1 is a side view showing a part of a motorcycle in which an engine made in accordance with the present invention is incorporated.

The presently preferred embodiment of the invention will now be described in detail with reference to the accompanying drawings. FIG. 1 is a side view showing a part of a motorcycle in which a 4-cylinder V-type 4-cycle engine E made in accordance with the present invention is incorporated. The motorcycle has a fuel tank 1 and a seat 2 on the upper portion of the motorcycle body and an engine E in the space defined by the motorcycle frame 3.

Figure 2:
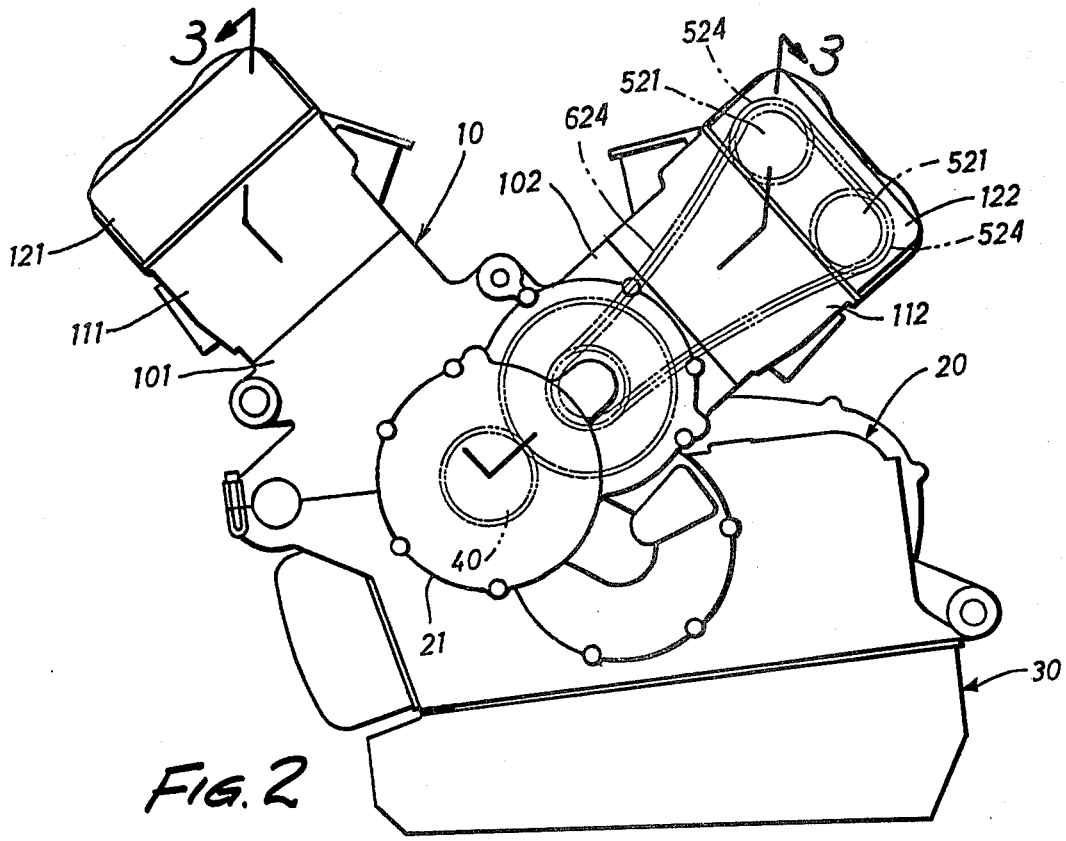
FIG. 2 is a side view of the engine of FIG. 1.
Figure 3:
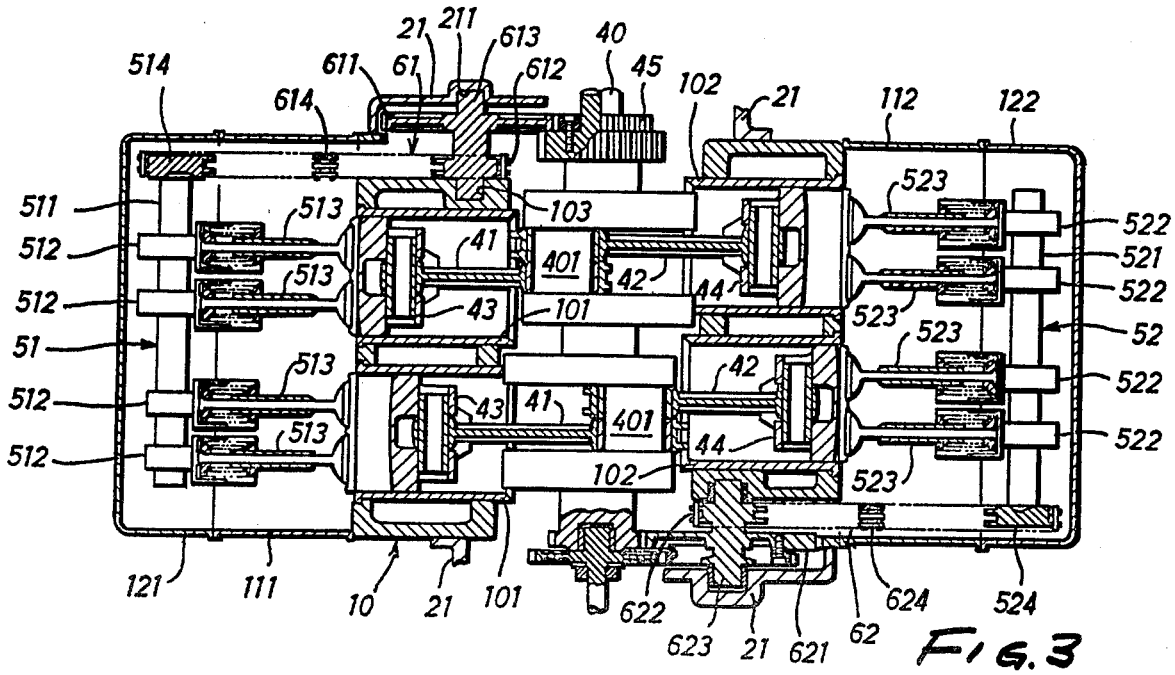
FIG. 3 is a sectional view taken along the line 3—3 of FIG. 2.

The engine E is shown in detail in FIGS. 2 and 3 as comprising a transmission unit housing 20 having its upper end secured to the lower end of a cylinder block 10, and an oil pan 30 fixed to the lower end of the housing 20. The cylinder block 10 includes in its upper portion four cylinders 101, 101, 102 and 102 arranged in a V-shaped fashion at a 90° angle between the banks. The front cylinders 101 and 101 (front "bank") have at their upper ends a cylinder head 111 covered with a head cover 121, and the rear cylinders 102 and 102 (rear "bank") have at their upper ends a cylinder head 112 covered with a head cover 122. Provided below the cylinders 101, 101, 102 and 102 is a crank shaft 40 which is borne for rotation by bearing (not shown) provided in the connection plane between the cylinder block 10 and the transmission unit housing 20. The opposite ends of the crank shaft 40 are covered with covers 21 and 21. The crank shaft 40 has crank pins 401 to which connecting rods 41, 41, 42 and 42 are attached with a displacement. The tip ends of the connecting rods 41, 41, 42 and 42 are connected to respective pistons 43, 43, 44 and 44 extending into the cylinders 101, 101, 102 and 102. A first cam drive mechanism 51 is provided above the cylinders 101 and 101 which includes two cam shafts 511 and 511 for opening and closing intake valves 513 and exhaust valves (not shown) through a plurality of cams 512 arranged above the cam shafts 511. In a similar fashion, a second cam drive mechanism 52 is provided above the cylinders 102 and 102 which includes two cam shafts 521 and 521 for opening and closing intake valves 523 and exhaust valves (not shown) through a plurality of cams 522.

Because the cylinders are staggered, the engine arranged as described above has a recess in the side of the front right-hand cylinder 101 and another recess in the side of the rear left-hand cylinder 102. First and second interlocking devices 61 and 62 for drivingly connecting the cam drive mechanisms 51 and 52 to the crank shaft 40 are placed in the respective recesses. Because they are located in the recesses, they do not project beyond the envelope defined by the cylinders. The first interlocking device 61 is placed in the recess formed adjacent to the forward, right-hand cylinder includes a coupling shaft 613 having thereon a gear 611 and a pinion 612, and a chain 614. The coupling shaft 613 is borne by a bearing portion 103 provided in the cylinder block and a bearing portion 211 provided in the cylinder block cover 21 such that the gear 611 is in mesh engagement with a second gear 45 fixed to the crank shaft 40. The chain 614 is journalled on the pinion 612 on the shaft 613 and gears 514 and 514 provided on one end of the cam shaft 511 for transmitting rotation of the crank shaft 40 to the cam shafts 511 and 511. In a similar fashion, the second interlocking device 62 placed in the recess formed adjacent to the rear, left-hand cylinder, includes a coupling shaft 623 having thereon a gear 621 and a pinion 624, and a chain 622 for transmitting rotation of the crank shafts 521 and 521. The reference numeral 524 designates gears provided on the other ends of the cam shafts 521 and 521. A chain 624 is journalled on the gears 524.

The engine arranged as described above in accordance with the present invention, in which first and second interlocking devices 61 and 62 are placed in respective recesses naturally formed adjacent to one side of the front cylinder and adjacent to the other side of the rear cylinder in order to drivingly connect the cam drive mechanisms 51 and 52 to the crank 40, provides a reduced envelope width as compared to conventional V-type or horizontally opposed engines in which the interlocking devices are placed at the same side of the cylinders.

Although the present invention has been described in detail with reference to a preferred embodiment thereof, it is to be understood, of course, that the present invention is applicable to horizontally opposed 4-cycle engines and also to V-type 4-cycle engines of known various types. In addition, the application of the present invention is not limited to double over head cam type 4-cycle engines as described in the above embodiment and is also applicable to single overhead cam type 4-cycles engines.

We claim:

1. An internal combustion engine comprising: a first and a second cylinder bank, each bank having at least one cylinder; a crank shaft having an axis; intake and exhaust valves in each of said cylinders; a piston in each cylinder; a rod assembly connecting each piston to the crank shaft, said cylinders being staggered from bank to bank along said axis, said staggered arrangement leaving a first recess at one axial end of said first bank, and a second recess at the opposite end of said second bank; and a respective valve actuating means for each of said banks including valve motive means for opening and closing said valves, and a first and a second interlocking means, said first interlocking means being disposed in said first recess, and said second interlocking means being disposed in said second recess, said interlocking means being coupled to said crank shaft and to their respective said motive means.

2. An internal combustion engine according to claim 1 in which each said valve motive means comprises an overhead crank shaft, and each said interlocking means comprises a chain drive.

3. An internal combustion engine according to claim 1 in which the banks are arranged as a V.

4. An internal combustion engine according to claim 1 in which the banks are opposed.

5. In an internal combustion engine of the type which includes a first and a second cylinder bank, each bank having at least one cylinder; a crank shaft having an axis, intake and exhaust valves in each of said cylinders, a piston in each cylinder, a rod assembly connecting each piston to the crank shaft, said cylinders being staggered from bank to bank along said axis, said staggered arrangement leaving a first recess at one axial end of said first bank, and a second recess at the opposite end of said second bank, and a respective valve actuating means for each of said banks including valve motive means for opening and closing said valves, the improvement comprising: a first and a second interlocking means, said first interlocking means being disposed in said first recess, and said second interlocking means being disposed in said second recess, said interlocking means being coupled to said crank shaft and to a respective one of said motive means.

6. Apparatus according to claim 5 in which each said valve motive means comprises an overhead crank shaft, and each said interlocking means comprises a chain drive.

7. An internal combustion engine according to claim 5 in which the banks are arranged as a V.

8. An internal combustion engine according to claim 5 in which the banks are opposed.

* * * * *